United States Patent [19]

Mitsukuchi et al.

[11] Patent Number: 4,761,523

[45] Date of Patent: Aug. 2, 1988

[54] GAS SWITCH WITH PRESSURE RECEASE COVER

[75] Inventors: Kunio Mitsukuchi; Hiromitsu Ito; Isamu Eguchi; Bunji Hirasato; Takashi Furuhata, all of Inuyama, Japan

[73] Assignee: Takamatsu Electric Works, Ltd., Inuyama, Japan

[21] Appl. No.: 64,043

[22] Filed: Jun. 18, 1987

Related U.S. Application Data

[62] Division of Ser. No. 838,229, Mar. 10, 1986.

[51] Int. Cl.[4] ..... H01H 33/54

[52] U.S. Cl. ..... 200/148 B; 200/148 R

[58] Field of Search ..... 200/148 R, 148 B

[56] References Cited

U.S. PATENT DOCUMENTS 3,348,001 10/1967 Upton, Jr. et al. ..... 200/148 R
3,356,798 12/1967 McKinnon ..... 200/148 B

FOREIGN PATENT DOCUMENTS 60-94748 6/1985 Japan ..... 200/148 R

*Primary Examiner*—Robert S. Macon

*Attorney, Agent, or Firm*—Jordan and Hamburg

[57] ABSTRACT

Herein disclosed is a gas switch comprising: a body casing having an arc-extinguishing gas such as the SF6 gas and the like confined therein; bushings having their inner end portions inserted into said body casing; a rod-shaped stationary electrode and a hollow stationary electrode attached to the inner end portions of the bushings movable electrodes contacting with the rod-shaped stationary electrode at all times and made movable into and out of contact with said hollow stationary electrode; insulated bearing sleeves bearing the movable electrodes, respectively; a plurality of rocking arms for rocking in association with the turn of a drive shaft so that the movable electrodes are linearly moved through the insulated bearing sleeves by the rocking motions of the rocking arms to open and close the gas switch; and a connecting mechanism for connecting the rocking arms to the insulated bearing sleeves, respectively. The connecting mechanism includes: engaging grooves formed in the outer sides of the insulated bearing sleeves and opened at their sides facing the drive shaft; and engaging projections so formed in portions of the rocking arms as to directly engage with the engaging grooves and allowing in their engaging states the rocking arms to rock in the engaging grooves.

4 Claims, 11 Drawing Sheets

GAS SWITCH WITH PRESSURE RECEASE COVER

BACKGROUND OF THE INVENTION

1. Field of the Invention

The present invention relates to a gas switch and, more particularly, to a gas switch which is constructed such that bushings are fixed gas-tight in the two side faces of a body casing, such that an arc extinguishing gas such as the SF6 gas and the like is confined in the body casing, such that stationary electrodes are mounted on the respective inner ends of the two bushings, such that a movable electrode made movable by an external operation is so arranged in a horizontally movable manner as to correspond to the stationary electrodes thereby to turn on and off a load current, and such that there is mounted on the side face of the body casing other than the mounting faces of the bushings a pressure release mechanism for releasing an internal gas pressure when this gas pressure abnormally rises.

2. Description of the Prior Art

Generally speaking, the gas switch of the above-specified type is constructed of: a plurality of bushings extending through and across a body casing; a stationary electrode connected with conductors mounted in those bushings; a movable electrode corresponding to the stationary electrode; an actuating mechanism for moving said movable electrode straight; and a pressure release mechanism for releasing an internal abnormal pressure.

And, the actuating mechanism used for moving said movable electrode straight is exemplified by rocking arms which are connected to the movable electrode and adapted to rock by the turn of an externally actuating shaft. Between each rocking arm and the movable electrode, there is interposed a link mechanism by which the rocking motions of the rocking arms are transformed into the linear movements of the movable electrode.

In case that link mechanism is provided, however, the assembly of the rocking arms with the movable electrode is troublesome, and the assembled structure is complicated. Moreover, the presence of the link mechanism raises the problems that the assembled portion is large-sized to require an accordingly large space, and that the movements of the movable electrode lose smoothness.

SUMMARY OF THE INVENTION

An object of the present invention is to provide a gas switch which is enabled to simplify the assembled structure of the movable electrode and the rocking arms for moving the movable electrode and to facilitate the assembly itself in the body casing.

Another object of the present invention is to provide a gas switch in which the structure of a pressure release mechanism for releasing an abnormal pressure in the body casing is simplified.

Still another object of the present invention is to provide a gas switch which can have its pressure release cover protected by a protecting member.

A further object of the present invention is to provide a gas switch in which the protecting member for the pressure release cover does not obstruct the pressure release but allows it to be smoothly effected.

A further object of the present invention is to provide a gas switch which can make it unnecessary to attach a bushing cover to the bushing of each phase and can reduce the number of parts of the bushing cover so that the assembling efficiency of the whole structure can be improved.

In order to achieve the above-specified objects, the gas switch according to the present invention comprises: a body casing having an arc extinguishing gas such as the SF6 gas and the like confined therein and including side walls opposed to each other and having bushing through holes; bushings having their inner end portions inserted into said through holes, respectively, and having bores extending therethrough in the axial directions thereof; fixing means for fixing said bushings in said body casing in a manner to maintain the internal gas-tightness of the same such that said bushings have, in their fixed states, their respective flanges contacting with the outer surfaces of said side walls; conductors inserted into the respective through holes of said bushings and having their respective outer ends retained in the outer end portions of said bushings; a rod-shaped stationary electrode and a hollow stationary electrode attached to the respective inner end portions of said conductors and opposed in said body casing to each other; movable electrodes contacting with said rod-shaped stationary electrode at all times and made movable into and out of contact with said hollow stationary electrode; insulated bearing sleeves bearing said movable electrodes, respectively; a plurality of rocking arms for rocking in association with the turn of a drive shaft so that said movable electrodes are linearly moved through said insulated bearing sleeves by the rocking motions of said rocking arms to open and close said gas switch; and a connecting mechanism for connecting said rocking arms to said insulated bearing sleeves, respectively, said connecting mechanism including engaging grooves formed in the outer sides of said insulated bearing sleeves and opened at their sides facing said drive shaft, and engaging projections so formed in portions of said rocking arms as to directly engage with said engaging grooves and allowing in their engaging states said rocking arms to rock in said engaging grooves.

According to the another aspect, a gas switch of the present invention comprising: a body casing having an arc-extinguishing gas such as the SF6 gas and the like confined therein; a movable electrode and a stationary electrode adapted to be moved toward and apart from each other in said body casing; a side wall forming part of said body casing and having a pressure release hole for releasing an abnormal gas pressure in said body casing; a pressure release cover covering said pressure release hole for warping out of engagement with the same when in the pressure releasing operation to release said abnormal gas to the outside of said body casing; and a protecting member for protecting the outer side face of said pressure release cover.

Other objects of the present invention will become apparent from the embodiments to be described and will be clearly defined by the appended claims. Moreover, a number of advantages left untouched will occur to those skilled in the art if the present invention is put into practice.

DESCRIPTION OF THE PREFERRED EMBODIMENTS

The present invention will be described in the following in connection with the embodiments thereof with reference to the accompanying drawings.

Figure 1:
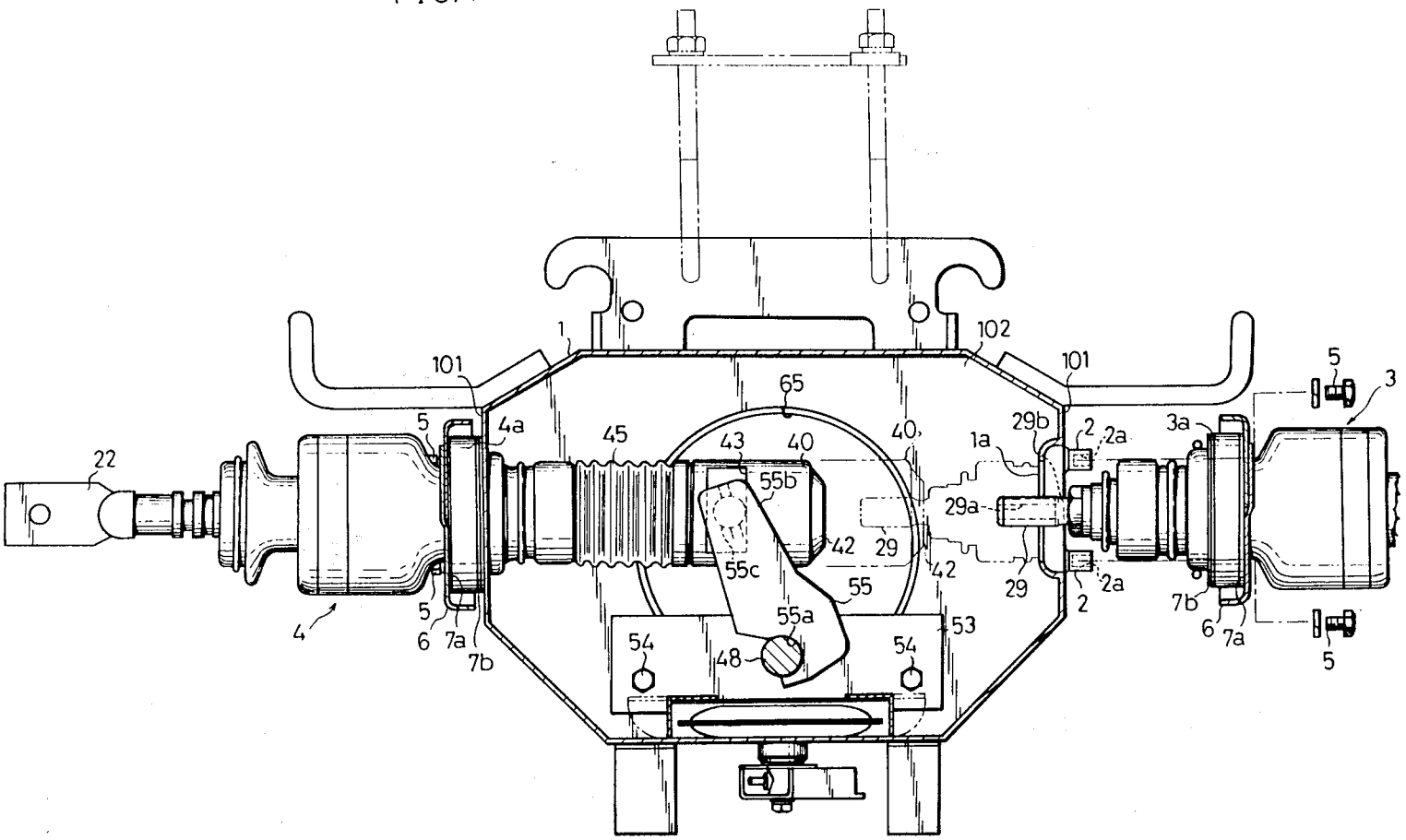
FIG. 1 is a sectional view showing the open state of a gas switch embodying the present invention.

As shown in FIG. 1, the body casing 1 of a gas switch confining an arc-extinguishing gas such as the SF6 gas and the like is formed into a box shape having an octagonal section, which has its one sidewall 102 formed at its central portion with a circular pressure release hole 65.

Figure 9:
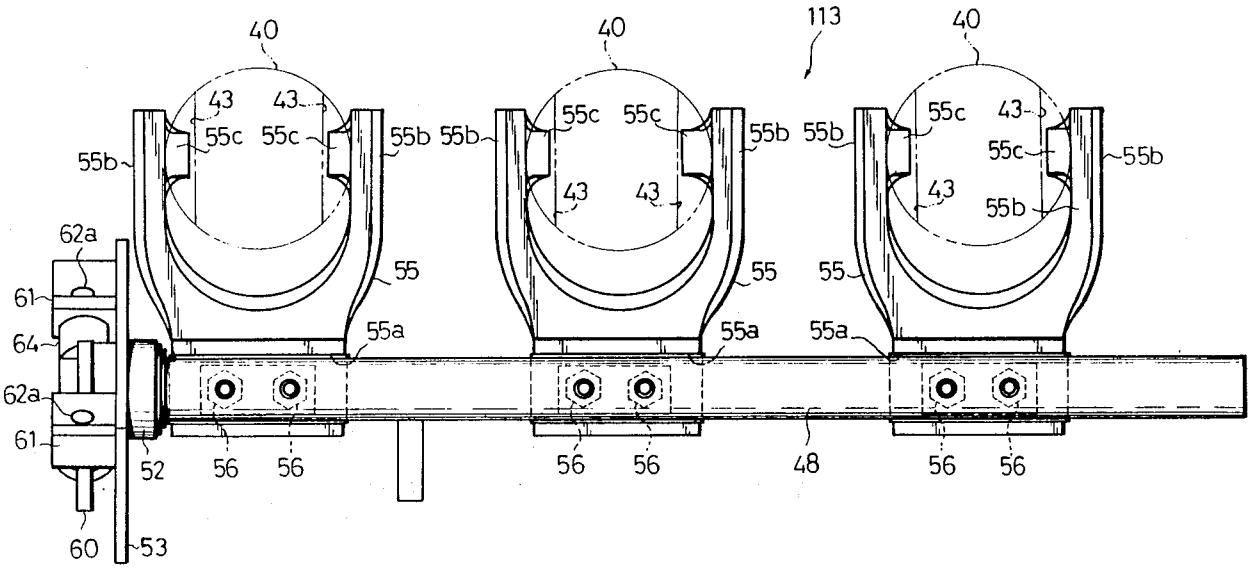
FIG. 9 is a front elevation showing an switch actuating mechanism.
Figure 11:
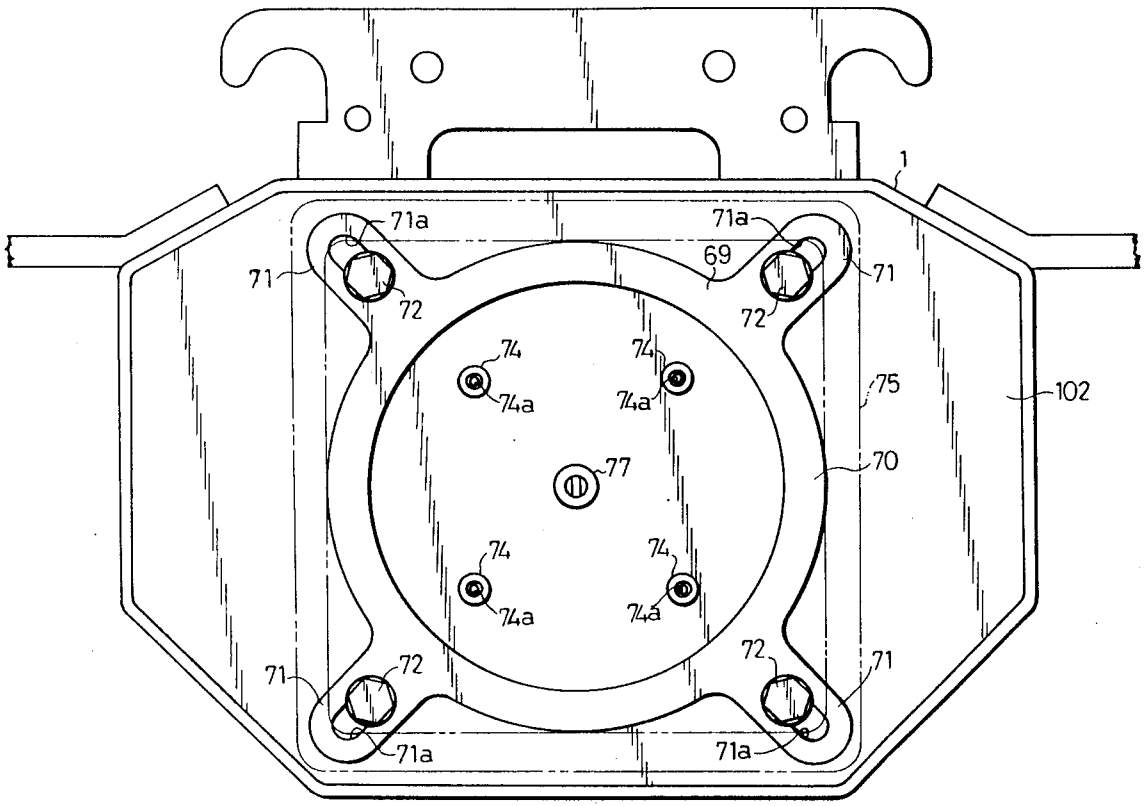
FIG. 11 is a front elevation showing the assembled state of a pressure release cover with a body casing.
Figure 12:
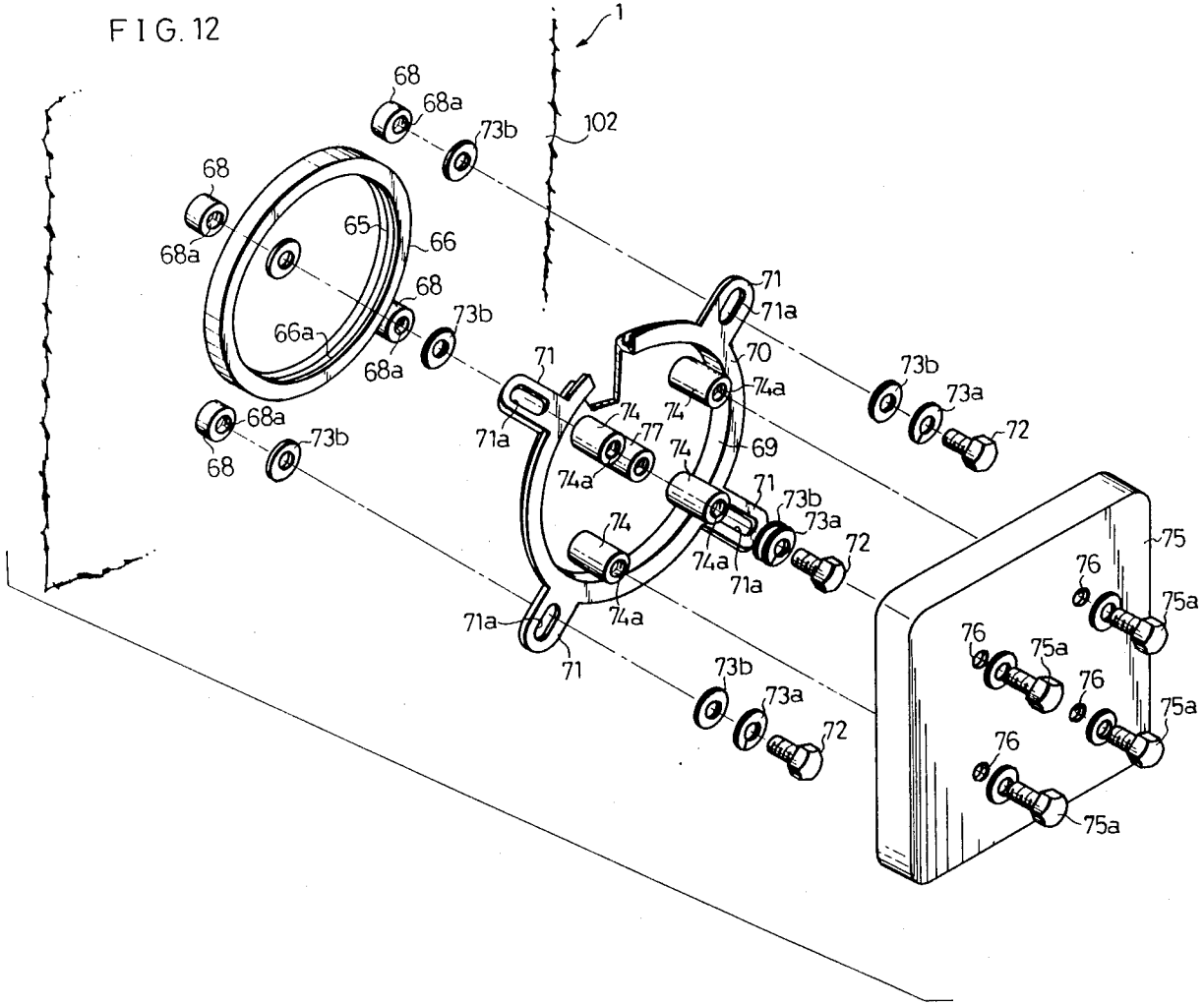
FIG. 12 is an exploded perspective view showing the pressure release cover and a protecting member.
Figure 13:
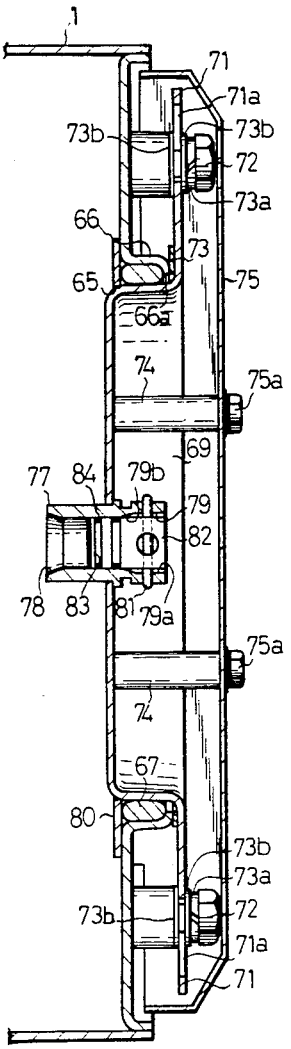
FIG. 13 is a section showing a pressure release mechanism.

With reference to FIG. 9 as well as FIG. 1, there is borne in the body casing 1 a drive shaft 48 which is so externally actuated by a not-shown manual or automatic actuating mechanism as can be turned below a rod-shaped stationary electrode 23 while covering the respective phases. To one end of said drive shaft 48, there is attached through a bearing member 52 a mounting plate 53 which is fixed to the side wall 102 of the body casing 1 by means of bolts 54.

Figure 10:
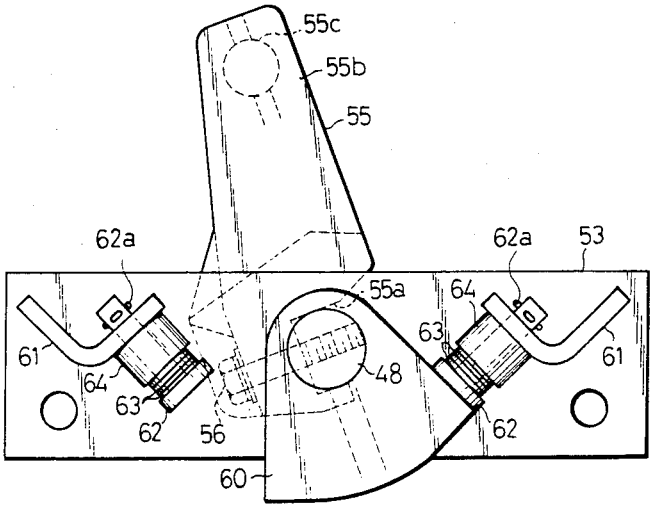
FIG. 10 is a side elevation showing the switch actuating mechanism.

The aforementioned drive shaft 48 is equipped for individual phases with insulated rocking arms 55 which are made of a synthetic resin or the like. Each of the rocking arms 55 is attached, as shown in FIG. 10, by inserting the drive shaft 48 into a mounting recess 55*a* formed in the base end portion and by inserting a bolt 56 from one side of the base end portion and driving it into the drive shaft 48.

The aforementioned rocking arm 55 has its leading end portion formed in its entirety into a U-shape having a pair of arm portions 55*b*, between which is arranged an insulated bearing sleeve 40 fitted on the outer circumference of a later-described movable electrode 30. Moreover, the facing inner sides of the arm portions 55*b* are formed with engaging projections 55*c*, which are fitted in engaging grooves 43 formed in both the sides of the aforementioned insulated bearing groove 40. When the drive shaft 48 is turned for closing or opening, more specifically, the insulated bearing sleeve 40 is driven through the engaging projections 55*c* of the rocking arm 55. To the other end of the drive shaft 48 projecting from the mounting plate 53, as shown in FIG. 10, there is fixed a retaining lever 60 which has a sector shape. On the outer surface of the mounting plate 53, moreover, there are fixed a pair of mounting members 61 which are positioned at both the sides of the aformentioned drive shaft 48 and which are equipped with stoppers 62 constructing the adjusting unit.

Each stopper 62 has its base end portion extended through the mounting member 61 while fitting thereon a plurality of spacers 63 and an elastic member 64 of rubber, which construct the adjusting unit together with that stopper 62. This stopper 62 is fixed by inserting a cotter pin 62*a* through its base end portion. Moreover, the drive shaft 48 can be freely turned if the stopper 62 is not attached to the mounting member 61, but the retaining lever 60 comes into engagement with the stopper 62 to regulate the turn of the drive shaft 48 if the stopper 62 is attached to the mounting member 61. By increasing or decreasing the number of the spacers 63 fitted on the stopper 62, still moreover, the turn of the drive shaft 48 can be finely adjusted.

The drive shaft 48 and rocking arms 55 thus far described constitute together the actuating mechanism 113.

The aforementioned body casing 1 is formed its right and left side walls 101 with bushing through holes 1*a* for three phases. Each of these through holes 1*a* is formed with a flanged portion by baring a portion of the side wall 101 inward into the body casing 1 and by subsequently folding the worked inner circumferential edge inward. Each side wall 101 is further formed around the through holes 1*a* with eight supporting tubes 2 sharing the intermediate phase, which tubes are formed with threaded holes 2*a* at their leading end portions.

Into the through holes 1*a* of the aforementioned right and left side walls 101, there are hermetically inserted supply side and load side bushings 3 and 4. These supply side bushing 3 and load side bushing 4 are fixed by means of mounting bolts 5 which retain a bushing cover 111 on their flanges 3*a* and 4*a* formed on their outer circumference and which are driven into the threaded holes 2*a* of the aforementioned supporting tubes 2 through the bushing cover 111.

Figure 7:
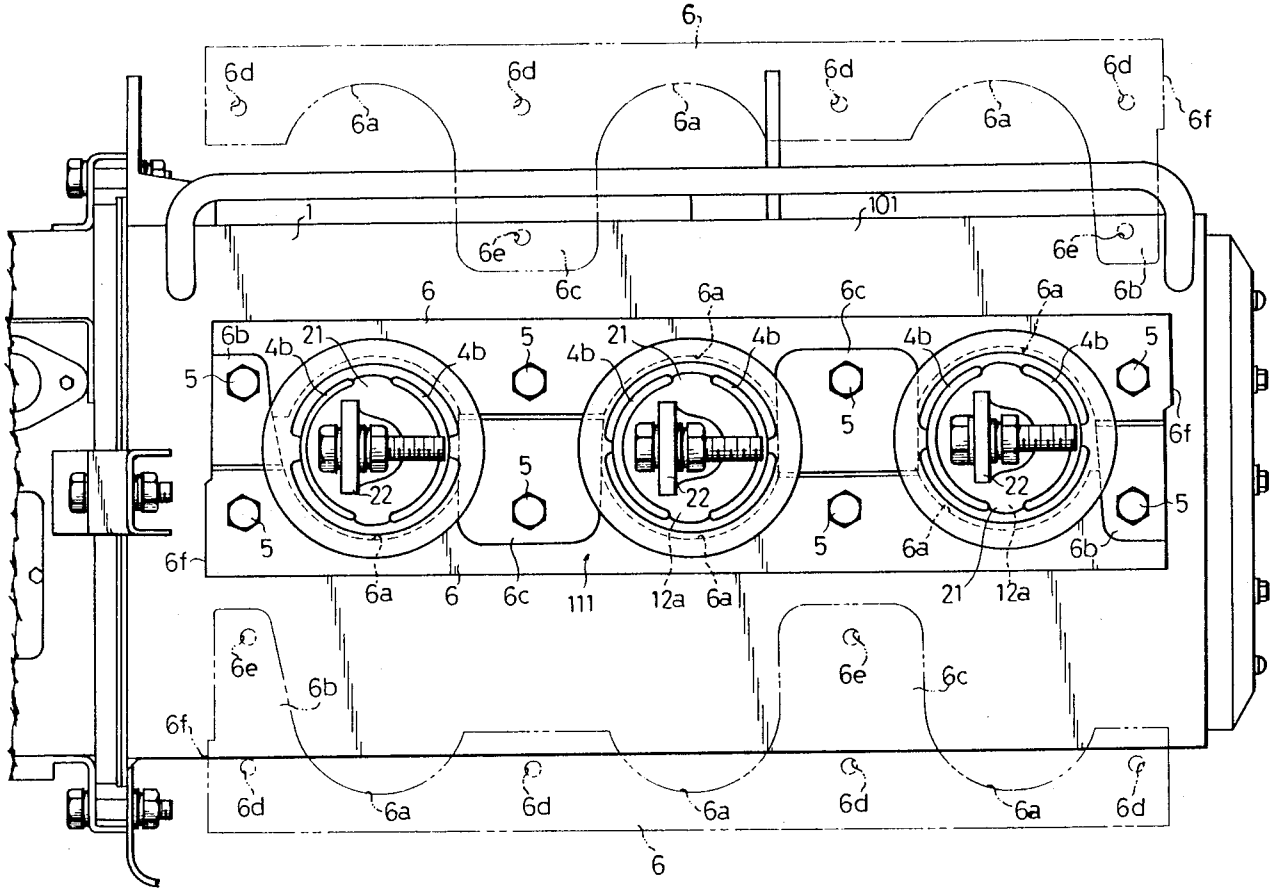
FIG. 7 is a partially omitted side elevation showing the gas switch.
Figure 8:
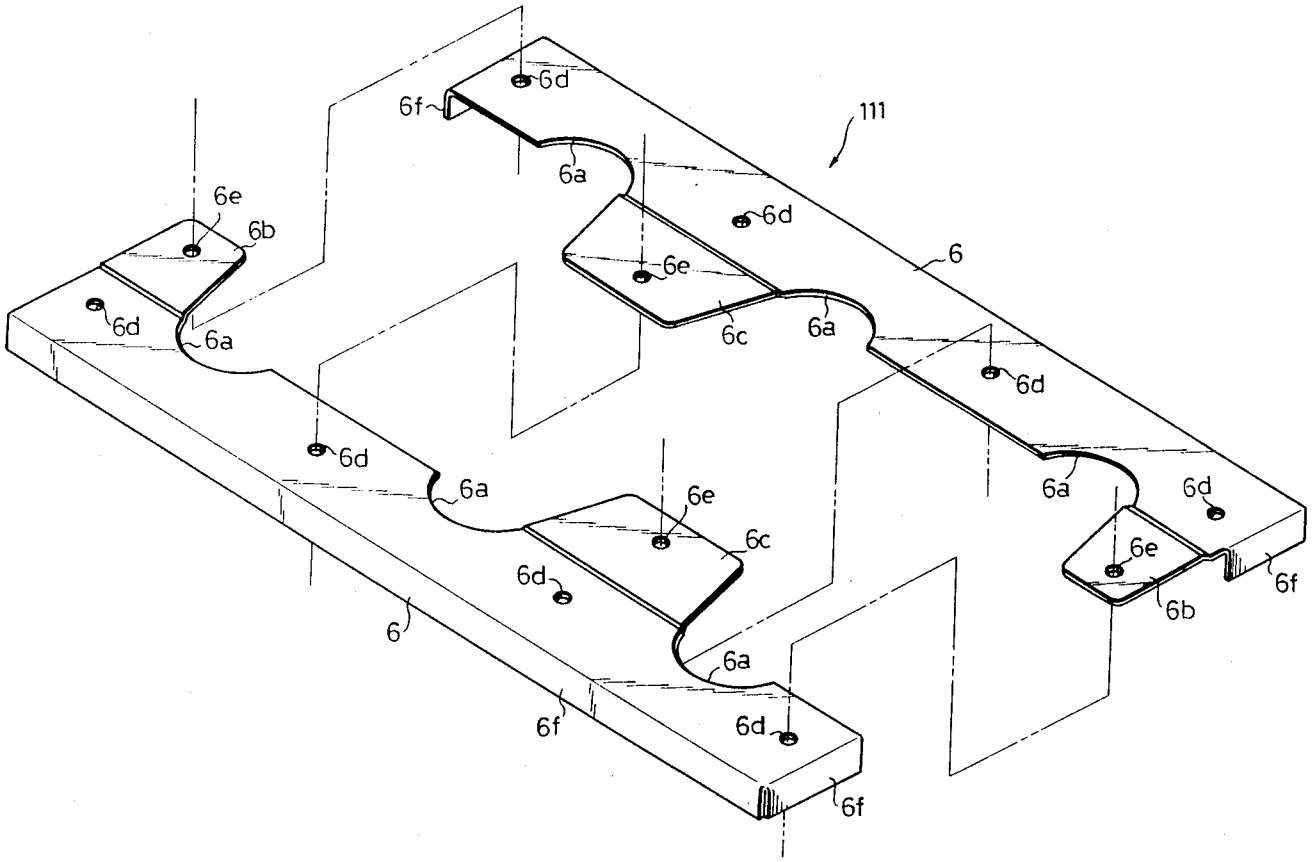
FIG. 8 is a perspective view showing a bushing cover.

Incidentally, this bushing cover 111 is constructed, as shown in FIGS. 7 and 8, of a pair of cover members 6 having an identical shape, which are arranged to be opposed to each other. More specifically, these two cover members 6 are formed at their opposed sides with arcuate cut-away portions 6*a* corresponding to the outer circumferences of the bushings 3 and 4 and at the side portions of their one-end portions with projections 6*b* which extend sideway through steps and which are arranged to contact with the upper surface of one of the opposed cover members 6.

Likewise at the opposed side portions of the cover members 6, there extend sideway between the cut-away portions 6*a* close to the other end portion and the central cut-away portions 6*a* projections 6*c* which are arranged to contact with the upper surfaces of one of the opposed cover members 6.

In these cover members 6, moreover, bolt holes 6*d* for the mounting bolts 5 corresponding to the supporting tubes 2 are formed on a straight line in the longitudinal direction, and the projections 6*b* and 6*c* are formed with bolts holes 6*e* into which are inserted the mounting bolts 5 shared with the corresponding bolt holes 6*d* of the cover members 6. The remaining three sides of the cover members 6 are formed with cover portions 6*f* which are folded in the form of letter "L".

Here, the method of assembling the bushing of each phase with the body casing 1 will be described by way of example.

The bushings of three phases are firmly fixed altogether to the side walls 101 of the body casing 1 by means of the bolts 5 and the inner faces of the box-shaped bushing cover 111, which is prepared such that the paired cover members 6 having their cut-away portions 6*a* opposed to each other with respect to the outer side of the flange 4*a* of the bushing 4 and such that the steps of the projections 6*b* and 6*c* of one cover member 6 are overlapped to coextend with the flat portions of the other cover member 6 until their mutual bolt holes 6*d* and 6*e* are aligned with each other.

This structure makes the number of parts less and the assembling works simpler than those in which the bushings are individually attached.

Figure 2:
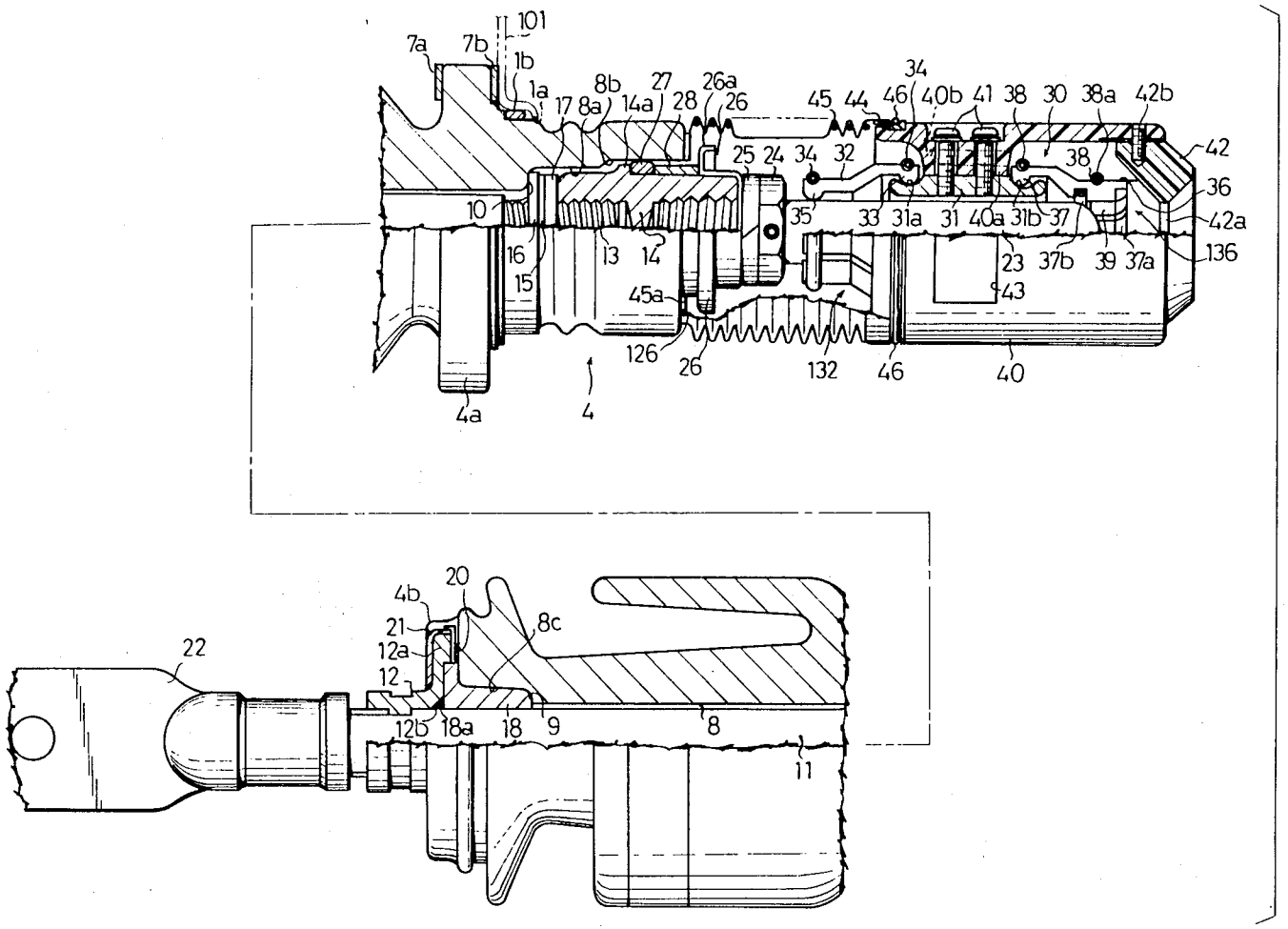
FIG. 2 is a half section showing a load side bushing having a movable electrode.

Incidentally, packings 7*a* and 7*b* are sandwiched between the flanges 3*a* and 4*a* of the bushings 3 and 4 and the cover members 6 and between the flanges 3*a* and 4*a* and the side walls 101 of the body casing 1. As shown in FIG. 2, moreover, O-ring 1*b* are sandwiched gas-tight between the inner circumferences of the aforementioned through holes 1*a* and the bushings 3 and 4.

In the bushing fixing fixtures of the switch of this kind, on the other hand, in case a high-current flows through the conductors extending through the bushings, eddy currents are generated in the fixing fixtures by that high-current to cause problems that the fixtures may be overheated and that the durabilities of the relevant parts such as the packings are degraded. Generally speaking, these problems may be solved by a method of forming the fixing fixtures of a non-magnetic material such as stainless steel. Even if the fixtures are made of iron or the like, however, the magnetic closed-circuit structure, which is liable to generate the aforementioned eddy currents, can be easily prevented according to the present invention by sandwiching an insulating substance such as a resin between the overlapped portions (i.e., the bolt inserting portions) of the aforementioned cover members 6.

Figure 3:
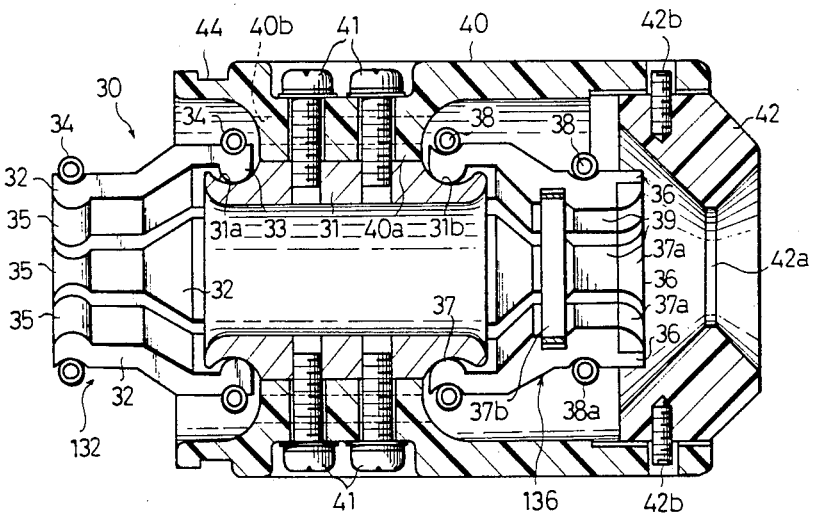
FIG. 3 is an enlarged section showing the movable electrode.

Next, the structure of the bushings will be described with specific reference to FIGS. 2 and 3. Incidentally, the description is limited to the load side bushing 4 for convenience of explanation because the supply side bushing 3 has the same structure as that of the load side bushing 4.

A bore 8 formed through and axially of the load side bushing 4 is formed in its inner and outer end portions, respectively, with retaining steps 9 and 10 and in its inner end portion with an enlarged portion 8*a* diverging from the bore 8 and a larger-diameter portion 8*b* having a larger diameter than that of the bore 8. On the outer circumference of the outer end portion of a conductor 11 inserted into the bore 8, there is fitted a retained flange 12 which is retained and caulked to the outer end face of the bushing 4.

The inner end portion of the aforementioned conductor 11 is formed in its outer circumference with a threaded portion 13, on which is screwed a connecting fixture 14 to be inserted into the enlarged portion 8*a*. The outer circumference of that connecting fixture 14 is formed at its central portion with a retaining ridge 14*a* which extends in the form of a ring.

Between the aforementioned connecting fixture 14 and retaining step 10, moreover, there are interposed a retaining fixture 15, a packing 16 and a spring washer 17, which are retained on the retaining step 10 and fitted on the conductor 11. As a result, when this conductor 11 is screwed into the aforementioned connecting fixture 14, this fixture 14 and the aforementioned retained flange 12 clamp the inner and outer ends of the bushing 4 so that the conductor 11 is firmly fixed.

At this conductor 11, there is sandwiched between the retained flange 12 and the bushing 4 a sealing member 18 which is made of an elastic material and which has its inner end fitted tightly in an enlarged portion 8*c* formed at the outer end of the bore 8. Incidentally, an adhesive such as an epoxy resin is applied between the sealing member 18 and the bushing 4.

Outside of the sealing member 18, moreover, a shock absorbing ring 20 is sandwiched between the retained flange 12 and the outer end face of the bushing 4. On the other hand, the retained flange 12 has its inner end face formed with a tapered portion 12*b* on its inner circumferential edge, and an O-ring 18*a* is sandwiched between that tapered portion 12*b* and the sealing member 18.

As shown in FIG. 7, the aforementioned bushing 4 is formed close to the outer edge of its outer end face with semi-arcuate turn stopping ridges 4*b* which are opposed to each other, and turn stopping ridges 12*a* projecting from the outer circumference of the retained flange 12 are fitted between the opposed end portions of the two turn stopping ridges 4*b* (as shown in FIG. 2). Incidentally, packings 21 are arranged to cover the outer circumferences of the aforementioned turn stopping ridges 12*a*. A terminal 22 is caulked to the outer end of the aforementioned conductor 11.

A rod-shaped stationary electrode 23 is screwed into the inner end face of the aforementioned connecting fixture 14 and is firmly fixed by fastening a nut 24, which is screwed on the outer circumference of the base end of the electrode 23, onto the connecting fixture 14 through a spring washer 25. On the rod-shaped stationary electrode 23, there is fitted a cap-shaped holding fixture 26 which is sandwiched between the spring washer 25 and the connecting fixture 26. This connecting fixture 26 has its leading end portion formed on its outer circumference with a flange 26*a*, and a fitting groove 126 is formed between that flange 26*a* and the inner end face of the load side bushing 4.

Between the outer circumference of the connecting fixture 14 and the larger-diameter portion 8*b* of the bushing 4, there is sandwitched an O-ring 27 for retaining the retaining ridge 14*a* in a manner to maintain the gas-tightness. Moreover, a gap regulating ring 28 is sandwiched between the aforementioned O-ring 27 and holding fixture 26 so that the whole circumferential pressure to be applied to the O-ring 27 is made even by the clamping pressure between the bushing 4 and the connecting fixture 14.

Incidentally, an externally threaded hollow stationary electrode 29 to be attached to the supply side bushing 3 is formed to have an external diameter equal to that of the rod-shaped stationary electrode 23 of the load side bushing 4 and a smaller length than that of the load side rod-shaped stationary electrode 23. Moreover, the hollow stationary electrode 29 is formed, as shown in FIG. 1, with a guide hole 29*a* having its leading end opened, which has its base end portion formed with a through hole 29*b* having communication with the outside.

A movable electrode 30 to be disposed on the rod-shaped stationary electrode 23 at the side of the load side bushing 4 will be described with reference to FIGS. 2 and 3.

A conductive cylinder 31 forming the movable electrode 30 is made conductive and capable of receiving the aforementioned rod-shaped stationary electrode 23. The conductive cylinder 31 has its two ends formed in their outer circumferences with circular mounting grooves 31*a* and 31*b*, which have their inner circumferences coated with an insulating synthetic resin such as polytetrafluoroethylene. In one mounting groove 31*a* of the conductive cylinder 31, there is mounted a first movable electrode 132 which is composed of a plurality of contact members 32.

The contact members 32 of the first movable electrode 132 are formed by dividing a conductive cylinder, which has its base end portion diameter enlarged and its leading end portion diameter reduced through a tapered portion, into six components in the longitudinal direction. Moreover, the individual contact members 32 are attached to the conductive cylinder 31 such that projections 33 formed on the inner circumference of their base end portions and having arcuate sections are arranged rotatably with respect to the mounting groove 31*a* and bundled by a pair of gutter springs 34 fitted on the outer circumferences of their two ends.

Moreover, the leading end portions of the contact members 32 are formed on their inner circumferences with projections 35 which are in sliding contact with the aforementioned rod-shaped stationary electrode 23.

Likewise, in the mounting grooves 31*b* of the aforementioned conductive cylinders 31, there is mounted a second movable electrode which is composed of a plurality of contact members 36.

More specifically, the contact members 36 of the second movable electrode 136 are formed by dividing a conductive cylinder, which has its base end portion diameter enlarged and its leading end portion diameter reduced through a tapered portion, into six components in the longitudinal direction. Moreover, the individual contact members 36 are attached to the conductive cylinder 31 such that projections 37 formed on the inner circumference of their base end portions and having arcuate sections are arranged rotatably with respect to the mounting groove 31*b* and bundled by a pair of gutter springs 38 fitted on the outer circumferences of their two ends. Incidentally, on the gutter springs 38 at the leading end side, there are fitted an arc-resistant tube 38*a* which is made of polytetrafluoroethylene or the like.

Moreover, the leading end portion of each contact member 36 is formed on its inner circumference with a land 39 which is to be brought into and out of contact with the hollow stationary electrode 29 at the supply side and which is equipped with an arc-proof metal 37*a* at its leading end portion. In the inner circumference of the leading end portion of each contact member 36, there is fitted a regulating ring 37*b* for regulating the internal diameter of the second movable electrode 136.

The conductive cylinders 31, and first and second movable electrodes 132 and 136 thus far described constitute together the movable electrodes 30.

Insulated bearing sleeves 40 to be fitted on the outer circumferences of the conductive cylinders 31 are formed by insulated and anti-gassed fiber reinforced plastic and are fixed integrally with the same by inserting the conductive cylinders 31 into flanged portions 40*a* formed on the inner circumferences of the insulated bearing sleeves 40 and by screwing fastening bolts 41 from the outer circumferences of the insulated bearing sleeves 40.

Figure 4:
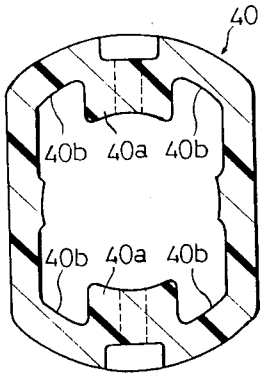
FIG. 4 is an enlarged section showing an insulated bearing sleeve.

As better seen from FIG. 4, the flanges 40*a* of the insulated bearing sleeve 40 are formed with a plurality of gas-permeable grooves 40*b* which extend in the axial direction of the bearing sleeve 40. In the inner circumference of the leading end portion of the insulated bearing sleeve 40, on the other hand, there is screwed an orifice cone 42 which is made of a synthetic resin having an excellent arc-resistance property and an insulating property and which is formed at its leading end portion with a nozzle portion 42*a* capable of receiving the aforementioned hollow stationary electrode 29. Incidentally, the orifice cone 42 is fixed by means of stop screws 42*b* which are driven from the outer circumference of the insulated bearing sleeve 40. The outer circumference of the insulated bearing sleeve 40 is formed in both its side portions with a pair of engaging grooves 43 (as shown in FIGS. 1 and 9). These engaging grooves 43 have their upper and lower ends opened.

The insulated bearing sleeve 40 has its base end portion formed in its outer circumference with a mounting groove 44. In this mounting groove 44, there is fitted one end of a bellows 45 on which a fixing band 46 is fitted gas-tight. The other end of the flange 45 is formed with a flange 45*a* which can be fitted in the fitting groove 126 and can slidably contact with the outer circumference with the gap regulating ring 28.

The aforementioned bellows 45 is made of such synthetic resin as is strong against the decomposed gas of the arc-resistant gas.

Next, other examples of the bushings 3 and 4 will be described with reference to FIGS. 5 and 6. Incidentally, since the supply side bushing 3 and the load side bushing 4 have the common structure, the description is limited for convenience to the load side bushing 4. The components having the same constructions as those of the foregoing embodiment are indicated at the common reference numerals, and their repeated descriptions are omitted.

Figure 5:
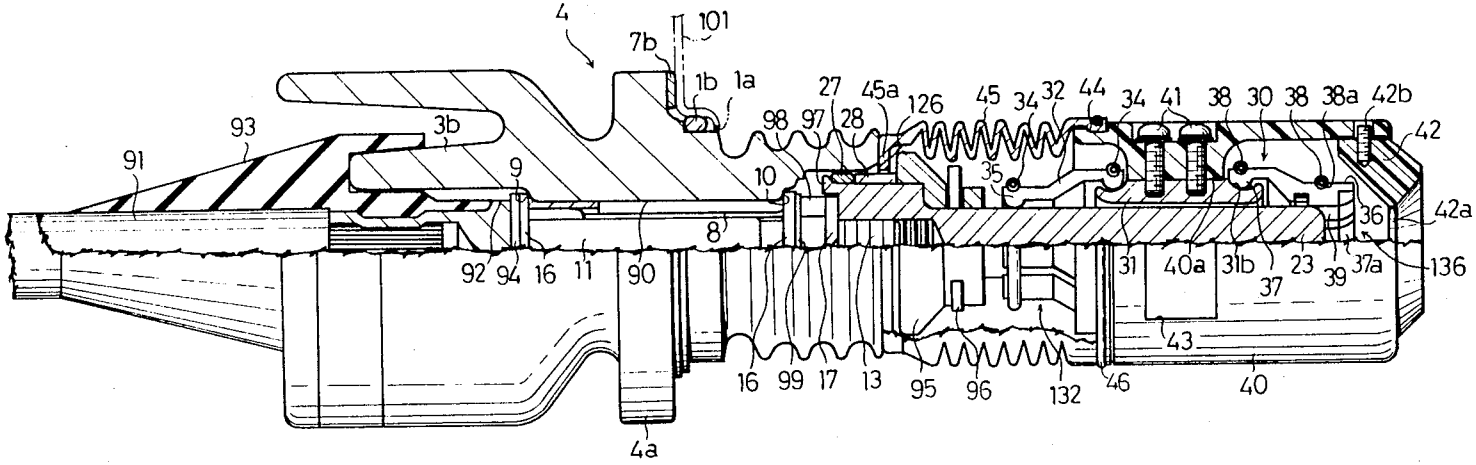
FIG. 5 a half section showing another example of the load side bushing having the movable electrode.
Figure 6:
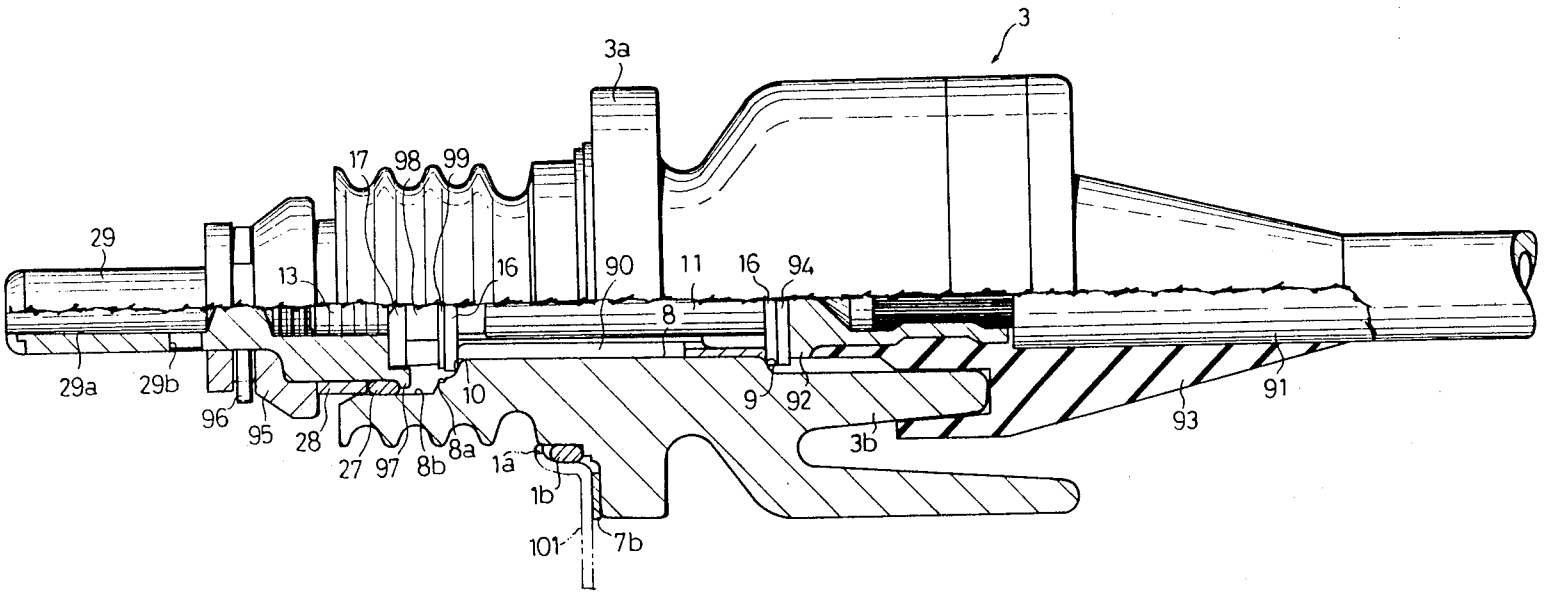
FIG. 6 is a half section showing another example of a supply side bushing.

As shown in FIG. 5, the two retaining steps 9 and 10 of the bore 8 are formed in their intervening inner circumference with a pair of fitting grooves 90 which are arranged in symmetrical positions and in parallel to the axis of the bushing 4. A lead wire 91 is caulked to the base end portion of the conductor 11, which is inserted in the aforementioned bore 8 and formed on its outer circumference with a retaining flange 92, and an adjusting washer 94 and the packing 16 are sandwiched between the retaining flange 92 and the aforementioned outer retaining step 9.

On the other hand, the outer end portion of the bushing 4 is formed with a rubber-molded cone 93 for molding the lead wire 91 while covering a mounting cylindrical portion 3*b* formed in the bushing 4. Incidentally, an adhesive such as an epoxy resin is applied between the said rubber-molded cone 93 and the mounting cylindrical portion 3*b*.

The conductor 11 has its inner end fixed by means of a nut 98 which in turn is retained on the retaining step 10. Incidentally, a shock absorbing seat 99 and the packing 16 are sandwiched between the nut 98 and the retaining step 10. The spring washer 17 is sandwiched between the nut 98 and the rod-shaped stationary electrode 23.

On the threaded portion 13 at the other end of the aforementioned conductor 11, there is screwed the base end of the rod-shaped stationary electrode 23, on which a holding fixture 95 is retained without fail by means of a cotter pin 96. A fitting groove 126 is formed between that holding fixture 95 and the load side bushing 4. A circular retaining ridge 97 is formed on the base end edge of the rod-shaped stationary electrode 23. O-ring 27 and gap regulating ring 28 are sandwitched between the retaining ridge 97 and the holding fixture 95.

Next, the pressure release structure of the body casing 1 will be described with reference to FIGS. 11 to 14.

To the outer edge of the pressure release hole 65 of the body casing 1, there is fixed or welded an O-ring retainer 66. This O-ring retainer 66 has its outer end formed on its inner edge with an inward projection 66*a*, and an O-ring 67 is fitted between the projection 66*a* and a retaining plate 80. Incidentally, this retaining plate 80 is so welded that the O-ring 67 may not come out and drop into the body casing 1. At the outer side of the O-ring retainer 66, there are fixedly welded to the body casing 1 four supporting tubes 68 which are formed with threaded holes 68*a* at their respective leading end portions.

In the aforementioned pressure release hole 65, there is fitted a cylindrical pressure release cover 69, which is fitted in the O-ring retainer 66 through the O-ring 67 while maintaining the gas-tightness. The outer end of the pressure release cover 69 is formed on its circumferential edge with an engaging flange 70 which is bent outward in the form of L-shaped section. The engaging flange 70 of the pressure release cover 69 is formed on its circumferential edge with four mounting members 71 which are formed at their respective leading end portions with slots 71*a* extending in the projecting directions thereof.

And, the pressure release cover 69 is fixedly fastened, while the mounting members 71 being aligned with the supporting tubes 68, by means of mounting bolts 72 which are screwed into the supporting tubes 68 through the slots 71*a*. Between the engaging flange 70 of the pressure release cover 69 and the O-ring retainer 66, there is sandwiched an annular packing 73 for dust-proof to protect the O-ring 67 against ultraviolet rays, impurities or rain droplets thereby to improve the stability of gas-tightness and the reliability.

Incidentally, reference numeral 73*a* indicates washers which are sandwiched between the heads of the mounting bolts 72 and the mounting members 71, and numeral 73b indicate flat washers which are sandwiched between the mounting members 71 and the supporting tubes 68 and between the mounting members 71 and the washers 73*a*. Those washers are attached so as to allow the mounting members 71 to smoothly slip and deform between the supporting tubes 68 and the mounting bolts 72 when a pressure is applied to the pressure release cover 69 so that the mounting members 71 deform.

Figure 14:
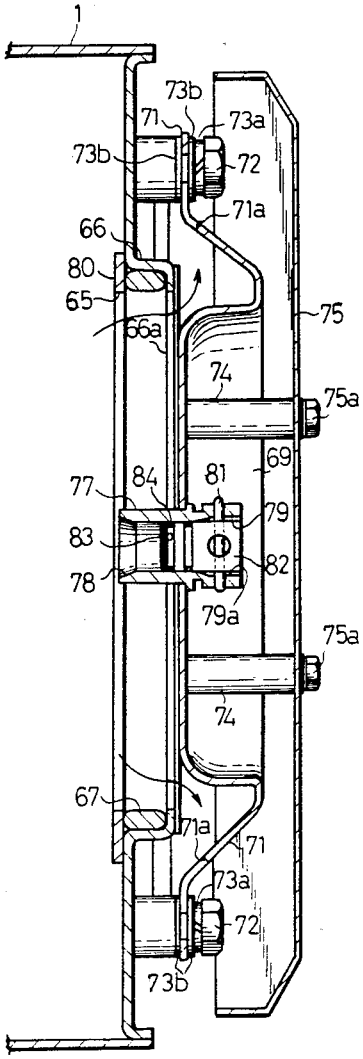
FIG. 14 is a section showing the operations of the pressure release mechanism.

The pressure release cover 69 is constructed such that the mounting members 71 are caused to slide and deform (or warp) outward (or rightward), as shown in FIG. 14, within a range permitted by the slots 71*a* by the internal pressure of the body casing 1, when this pressure rises, so that the internal pressure may be released to the outside through the gap which is established between the O-ring retainer 66 and the pressure release cover 69 as a result of the aforementioned slippage and deformation.

To the outer side of the pressure release cover 69, there are fixed four bearing tubes 74 which are formed with threaded holes 74*a* in their respective leading end portions. Outside of the pressure release cover 69, there is arranged a box-shaped protecting member 75. This protecting member 75 is formed with through holes 76 aligned with the aforementioned bearing tubes 74 so that it is attached to the pressure release cover 69 by means of mounting bolts 75*a* which are screwed into the bearing tubes 74 through those through holes 76. The protecting member 75 thus constructed is positioned at a predetermined spacing from the body casing 1 by its abutment against the leading end portions of the bearing tubes 74 and is arranged at a predetermined spacing from the pressure release cover 69 while covering the pressure release hole 65 from the outside.

Moreover, a gas sealing structure formed at the central portion of the pressure release cover 69 will be described in the following.

A sealed cylinder 77 of the gas sealing structure is fixed through the pressure release cover 69 and has its inner open end 78 counter-tapered, and its outer open end 79 has a larger-diameter portion 79*a* having a larger diameter than the internal diameter of the sealed cylinder 77, and a taper portion 79*b* tapered inward from that larger-diameter portion 79*a*. A cotter pin 81 is diametrically inserted into the outer end portion of that sealed cylinder 77.

A sealing plug 82 to be fitted in the sealed cylinder 77 is formed into a cylindrical shape having a diameter slightly smaller than the internal diameter of the sealed cylinder 77. The inner end portion of the sealing plug 82 is formed in its outer circumference with a plurality of fitting grooves 83, in which is fitted an O-ring 84 contacting closely with the inner circumference of the sealed cylinder 77.

Now, with the gas switch thus constructed, the method of assembling the actuating mechanism 113 into the body casing 1 will be described in the following.

This actuating mechanism 113 is mounted in the body casing 1 before the supply side and load side bushings 3 and 4 are assembled with the body casing 1.

As shown in FIGS. 9 and 10, the actuating mechanism 113, which has been assembled in advance to a state where the stoppers 62 and the spacers 63 are not attached yet to the mounting members 61, is mounted in the body casing 1 from the pressure release hole 65. Then, one end of the drive shaft 48 of the actuating mechanism 113 is inserted into a not-shown bearing, and the mounting plate 53 is fastened by means of the bolts 54 to bridge between the side walls 101 of the body casing 1.

Next, the three supply side bushings 3 having their inner ends assembled with the hollow stationary electrode 29, and the three load side bushings 4 having their inner ends assembled with the rod-shaped stationary electrode 23, the movable electrodes 30 and the insulated bearing sleeves 40 are inserted into the body casing 1 until the bushings 3 and 4 are fixed in the body casing 1.

Then, the paired engaging projections 55*c* of each rocking arm 55 are brought into engagement with the paired engaging grooves 43 of each insulated bearing sleeve 40 inserted into the body casing 1, as described above. Incidentally, the engaging projections 55*c* of the rocking arm 55 are brought, while the drive shaft 48 being turned, into the engagement with engaging the grooves 43 of the insulated bearing sleeve 40. In this particular state, the stoppers 62 are not attached yet to the mounting plate 53 of the actuating mechanism 113 so that the drive shaft 48 can be freely turned. This makes it possible to assemble the insulated bearing sleeves 40 and the rocking arms 55 with ease. In case the engaging projections 55*c* are to be brought into engagement with the corresponding engaging grooves 43, more specifically, they may sufficiently be inserted upward into the engaging grooves 43 by turning the drive shaft 48 to rock the leading ends of the rocking members 55 upward. As is different from the assembled structure of the prior art, therefore, no link mechanism is required, and the structure itself can be simplified while reducing the size of the assembled portions.

After this, the stoppers 62 bearing the plural spacers 63 and elastic members 64 are inserted through the respective mounting members 61 of the mounting plate 53, and the cotter pins 62*a* are inserted into the base end portions of the stoppers 62. Incidentally, the turn of the drive shaft 48 is finely adjusted by increasing or decreasing the number of the spacers 63 to be fitted on the stoppers 62. As a result, the opening and closing stroke of the movable electrodes 30 are adjusted.

After the actuating mechanism 113 has been mounted and assembled in the body casing 1, as described above, the pressure release hole 65 is closely fitted in the pressure release cover 69, and this pressure release cover 69 is mounted on the body casing 1 by means of the mounting bolts 72.

Thus, the actuating mechanism 113 can be mounted and assembled in the body casing 1 by making use of the pressure release hole 65.

The operations of the switch having the construction thus far described will be explained in the following.

With reference to FIG. 1 showing the open state, if the drive shaft 48 is turned in the closing direction (i.e., in the clockwise direction) by an actuation from the outside, the rocking arms 55 are also turned in the same direction so that the movable electrodes 30, the bellows 45 and the orifice cone 42 are accordingly moved through the insulated bearing sleeves 40 in the closing direction. At this time, the insulated bearing sleeves 40 move straight, but the inclining motions of the rocking arms 55 are allowed by the engaging grooves 43. As a result, the hollow stationary electrode 29 is fitted into the second movable electrode 136 of the movable electrode 30, and the bellows 45 in its contracted state, as shown in FIG. 1, is extended in accordance with the closing action. Then, a fresh gas is sucked into the bellows 45. At this time, the closing operation is completed.

Next, in the case of the opening operation, the rocking arms 55 are rocked in the opening direction from the closed state, as shown in dotted lines in FIG. 1, by the drive shaft 48. Then, the insulated bearing sleeves 40 associated with the rocking arms 55, the movable electrodes 30 and the bellows 45 are moved in the opening direction. When the second movable electrode 136 of the movable electrodes 30 leaves the hollow stationary electrode 29, moreover, an arc is generated among the leading end portions of the second movable electrode 136, the contact members 36 and the hollow stationary electrode 29. This arc is extinguished as the movable electrodes 30 move in the opening direction. At this time, the insulation is restored by the fresh gas which is released from the inside of the bellows 45 through the gas-permeable grooves 40*b* of the insulated bearing sleeves 40 and through the nozzle portion 40*a* of the orifice cone 42.

In the present embodiment, moreover, the gap regulating ring 28 for pushing the O-ring 27 is arranged in the inner end portion of the bores 8 of the bushings 3 and 4 so that any uneven pressure is not applied to the O-ring 27 even when the connecting fixture 14 is fastened to the conductor 11 or when the movable electrodes 30 are closed or opened. As a result, the gas-tightness relationship between the bushings 3 and 4 is not broken.

This will not degrade the opening and closing performance of the switch, which might otherwise be caused by degradation of the gas-tightness.

Moreover, the connecting fixture 14 can be centered with ease by means of the aforementioned gap regulating ring 28 so that the stationary electrodes 23 and 29 can be prevented from being offset when they are mounted.

In the pressure release structure of the switch, still moreover, the pressure in the body casing 1 will rise if an internal short-circuiting accident such as the interphase short-circuit occurs in the stationary electrodes 23 and 29 and movable electrodes 30 arranged in the body casing 1. That pressure pushes the pressure release cover 69 to the outside. Then, each mounting member 71 warps and deforms (while slipping) to the outside within the range allowed by its slot 71*a*.

As a result of the outward warp and deformation of the mounting member 71, the sealing between the O-ring retainer 66 and the pressure release cover 69 is broken, and the gap is formed between the O-ring 67 and the pressure release hole 65 so that the gas confined in the body casing 1 is released through that gap to the outside. At this time, the protecting member 75 arranged to cover the outside of the pressure release cover 69 is attached to the pressure release cover 69 so that it is carried to the outside together with the pressure release cover 69 when the latter deforms. This raises no obstruction to the gas being released from that gap.

This also prevents the body casing 1 from exploding as a whole to harm other devices and living creatures.

Moreover, the pressure release structure of the switch thus constructed will allow the pressure release cover 69 to release the pressure through the gap to be formed between the body casing 1 and the mounting members 71 of the cover 69 when the latter deform. As is different from the structure of the prior art in which the breakable plate is broken, therefore, there does not arise the problem that the pressure release cover 69 is broken due to its corrosion before the pressure reaches a predetermined level.

Still moreover, the breathing actions resulting from the temperature difference between the inside and outside of the body casing 1 are effected by the inward and outward movements of the pressure release cover 69. At this time, the O-ring 67 seals the entire outer circumference of the pressure release cover 69 so that its compressibility is not changed to maintain the stable sealing performance. This effect is prominent especially in the gas switch having the gas such as SF6 confined therein.

In the present embodiment, still moreover, the pressure release cover 69 is equipped with the gas sealing portion so that no area for sealing the gas is not required on the body casing 1. This contributes to the size reduction of the body casing 1.

The present invention should not be limited to the embodiments thus far described but can be embodied by another sealed type switch although the foregoing embodiments have been embodied by the gas switch.

What is claimed is:

1. A gas switch comprising:

(a) a body casing having an arc-extinguishing gas such as the SF6 gas and the like confined therein;

(b) a stationary electrode and a movable electrode adapted to be moved toward and apart from said stationary electrode in said body casing;

(c) a side wall forming part of said body casing and having a pressure release hole for releasing an abnormal gas pressure in said body casing;

(d) a pressure release cover covering said pressure release hole for warping out of engagement with the same when in the pressure releasing operation to release said abnormal gas to the outside of said body casing; and (e) a protecting member for protecting the outer side face of said pressure release cover.

2. A gas switch according to claim 1, wherein said side wall includes an O-ring retainer formed in the inner circumferential edge of said pressure release hole, further comprising an O-ring sandwiched between said O-ring retainer and said pressure release cover for sealing said pressure release cover and said pressure release hole in the state where the former covers the latter.

3. A gas switch according to claim 2, wherein said side wall further includes a plurality of supporting tubes fixed on the outer side of said O-ring retainer, and wherein said pressure release cover further includes a plurality of mounting members corresponding to said supporting tubes and each having a bolt through hole through which it is fastened by means of bolts to the corresponding one of said supporting tubes in the state where said pressure release cover covers said pressure release hole.

4. A gas switch according to claim 3, wherein the bolt through hole of each of said mounting members is a slot for admitting the warp of said pressure release cover.

* * * * *

UNITED STATES PATENT AND TRADEMARK OFFICE

CERTIFICATE OF CORRECTION

PATENT NO. : 4,761,523

DATED : August 2, 1988

INVENTOR(S) : Kunio Mitsukuchi et al

It is certified that error appears in the above-identified patent and that said Letters Patent are hereby corrected as shown below:

In the Title;

change GAS SWITCH WITH PRESSURE RECEASE COVER

TO GAS SWITCH WITH PRESSURE RELEASE COVER

Signed and Sealed this

Seventeenth Day of January, 1989

*Attest:*

DONALD J. QUIGG

*Attesting Officer*

*Commissioner of Patents and Trademarks*